United States Patent [19]

Stockton

[11] 4,074,533

[45] Feb. 21, 1978

[54] COMPOUND REGENERATIVE ENGINE

[75] Inventor: Thomas R. Stockton, Ann Arbor, Mich.

[73] Assignee: Ford Motor Company, Dearborn, Mich.

[21] Appl. No.: 703,884

[22] Filed: July 9, 1976

[51] Int. Cl.[2] ..... F02G 1/02

[52] U.S. Cl. ..... 60/620; 60/712

[58] Field of Search ..... 60/597, 620, 621, 517, 60/526, 39.69 A, 39.82 C, 712, 715

[56] References Cited

U.S. PATENT DOCUMENTS

| | | | |
|---|---|---|---|
| 158,087 | 9/1874 | Hirsch | 60/712 |
| 2,239,922 | 4/1941 | Martinka | 60/620 |
| 2,632,296 | 3/1953 | Houdry | 60/39.02 |
| 3,871,179 | 3/1975 | Bland | 60/526 |
| 3,923,011 | 12/1975 | Pfefferle | 123/196 A |

*Primary Examiner*—Carlton R. Croyle
*Assistant Examiner*—L. J. Casaregola
*Attorney, Agent, or Firm*—Joseph W. Malleck; Olin B. Johnson

[57] ABSTRACT

An Ericsson-Stirling type engine is disclosed having a semi-open regenerative working fluid system employing intermittent internal combustion. The regenerator is modified to act also as a catalytic combustor and is located at the terminal end of the unswept clearance volume most adjacent the high temperature chamber or hot swept space. The clearance volume is reduced and engine efficiency increased by (a) elimination of any leak path around the regenerator (b) positive exhaust purging, and (c) lower peak combustion temperature.

6 Claims, 8 Drawing Figures

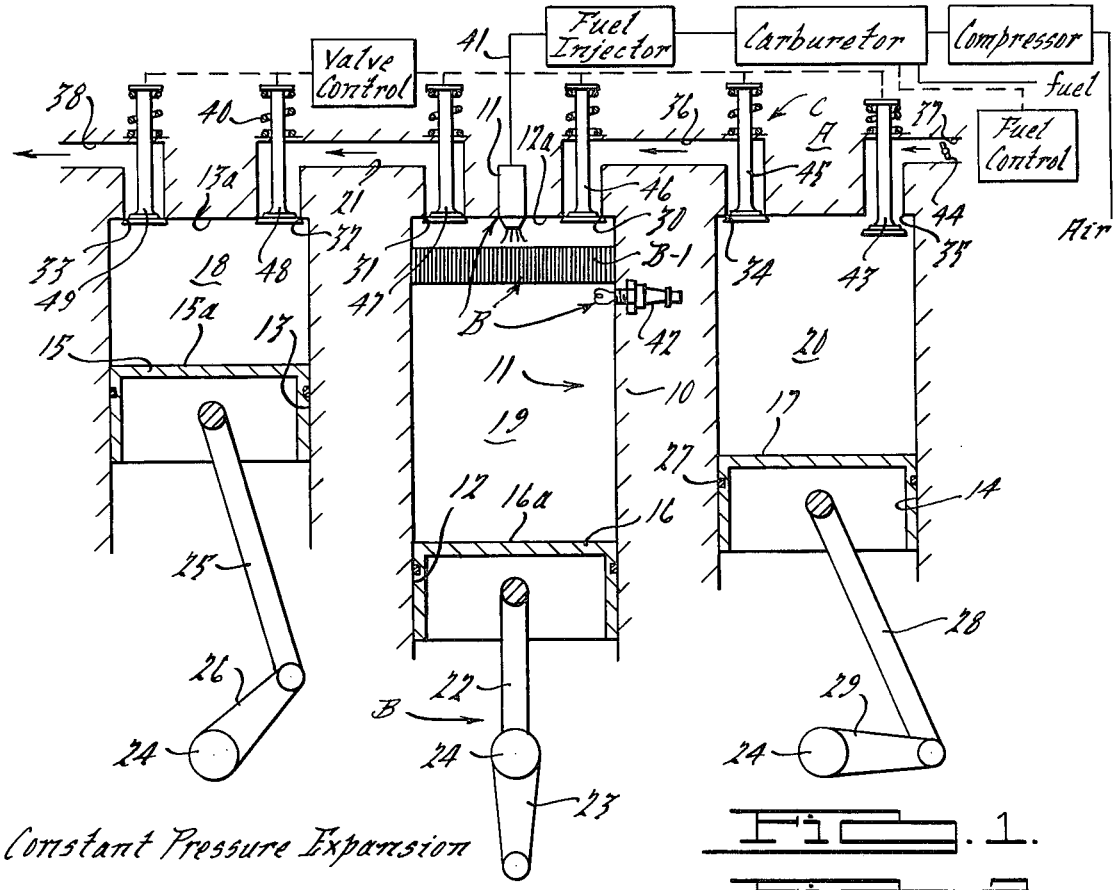
FIG. 1.
FIG. 2.
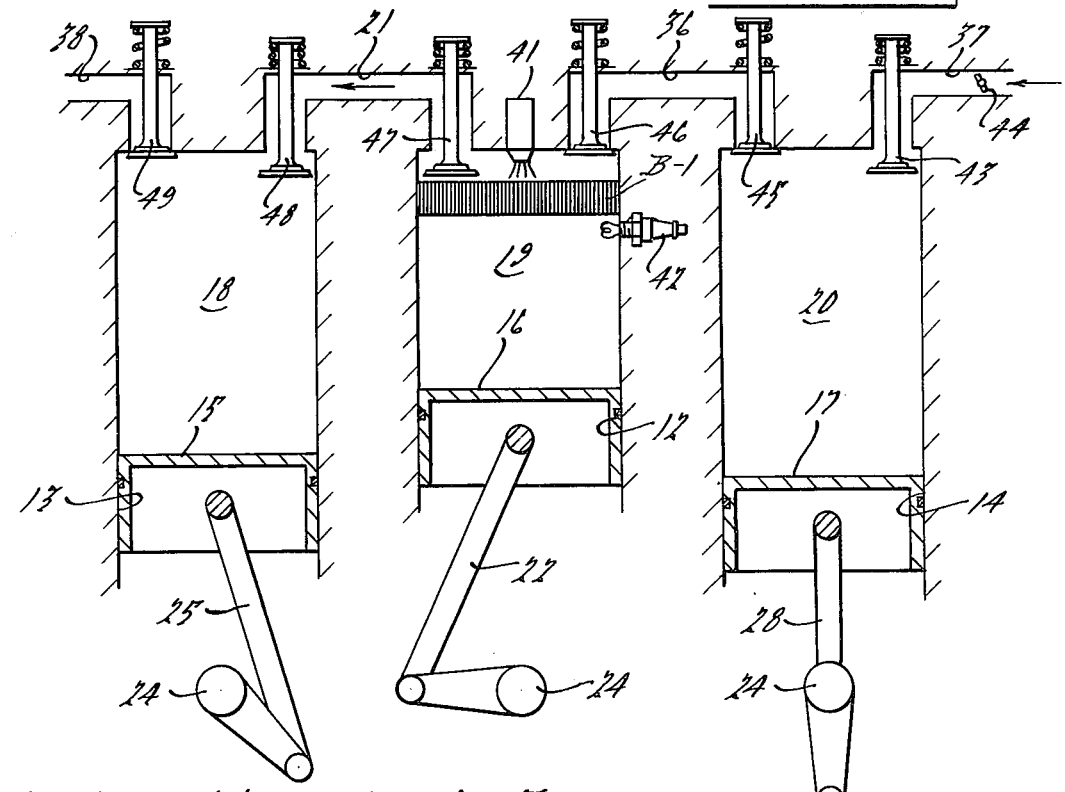
Constant Volume Transfer To Low Temperature Volume Constant Pressure Compression Constant Volume Transfer To Hot Volume

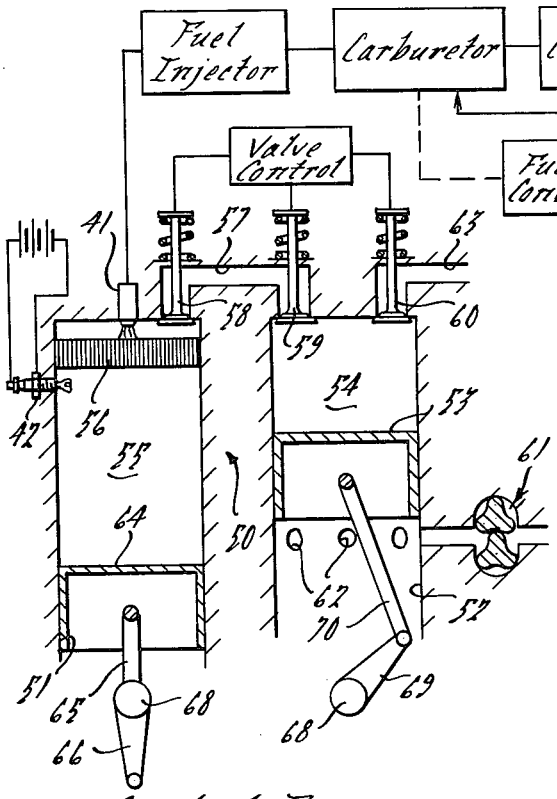
Constant Pressure Expansion
FIG. 5.
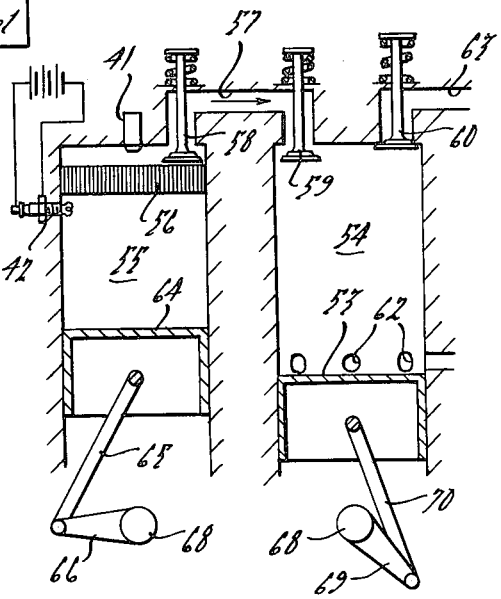
Constant Volume Transfer To Low Temp Volume
FIG. 6.
FIG. 7.
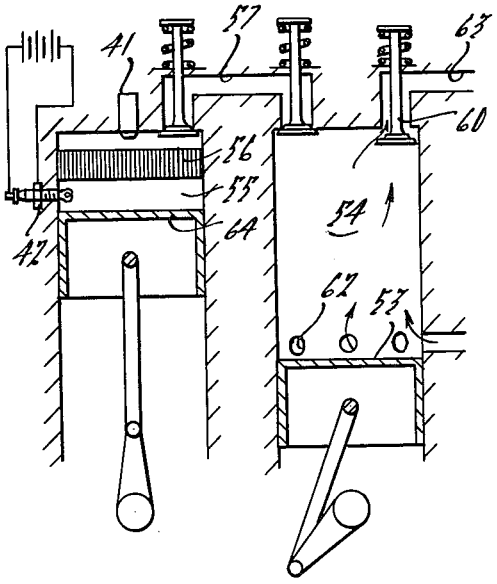
Constant Pressure Compression
FIG. 8.
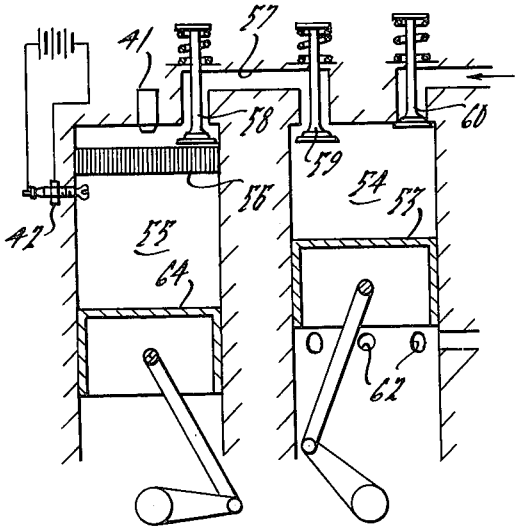
Constant Volume Transfer To Hot Volume

COMPOUND REGENERATIVE ENGINE

BACKGROUND OF THE INVENTION

The Stirling cycle engine utilizes contraction and expansion of heated and cooled inter-communicating gas volumes in timed relation to the extraction of working energy. Engines utilizing this cycle can be either of the external combustion type or of the internal combustion type. Typically those of the external combustion type should be referred to as a true Stirling type engine commensurate with the first embodiments of Rev. Stirling back in the early 1800's. When operating an internal combustion circuit, it is convenient to refer to such engine as an Ericsson type Stirling engine wherein the flow of working fluid is controlled by valves as opposed to the use of the volume changes to control flow. More simply, the regenerative thermodynamic cycle is closed in the true Stirling cycle machine and is open in the Ericsson-Stirling cycle machine. This invention is primarily concerned with an Ericsson-Stirling cycle machine.

External heating of a chamber, as required in a true Stirling engine, inherently requires substantial start-up time and necessitates the use of significant quantities of costly and limited high temperature metals, for example, nickel based alloys. Improved efficiency of heat transfer from such external heating circuit to the closed working fluid is obtained by use of a working fluid having low density and high thermal conductivity, such as hydrogen or helium. However, no convenient mass distribution means is currently available for vehicular users of these types of gases; such gases must be separately stored in the vehicle, thereby introducing additional cost factors.

SUMMARY OF THE INVENTION

The primary object of this invention is to provide a Stirling engine which will operate with intermittent combustion thereby eliminating the need for exotic high temperature materials, and at the same time have improved regeneration.

Another object of this invention is to provide an Ericsson-Stirling engine of the type that will operate on an open regenerative thermodynamic cycle requiring intermittent combustion, said intermittent combustion being improved.

Yet still another object of this invention is to provide an Ericsson-Stirling engine which has increased efficiency.

Features pursuant to the above objects comprise: (a) with respect to increasing efficiency, the use of a reduced clearance volume in the open circuit of said working fluid, provision for predetermined integral exhaust gas recirculation, provision of a positive displacement means effective to purge the low temperature spaces of the combusted working fluid when a reverse flow clearance volume is employed, or to use a plurality of commonly connected displacer means for timed regulation of intake and exhaust of the working fluid synchronized with intermittent combustion when a non-reversable working fluid path is employed; (b) with respect to improvement of regeneration in an Ericsson-Stirling cycle engine, the regenerator is immersed in the hot volume space of the working fluid path, constituting a part of the clearance volume, and located at the extreme end of said clearance volume; (c) with respect to improvement of combustion, the regenerator is constructed to act as both a regenerator and a catalyst to support chemical combustion within the hot volume space of the Ericsson-Stirling system.

SUMMARY OF THE DRAWINGS

FIGS. 1–4 are sequential schematic illustrations of a part of the working fluid system, in various cyclic phase conditions, of one embodiment of an Ericsson-Stirling engine, showing how a compound regenerative engine, in conformity with present invention, operates; this embodiment employs a uni-directional flow path having a plurality of commonly connected positive displacement means in independent spaces adapted to act as a control for intake and exhaust of said hot volume.

FIGS. 5–8 are schematic diagrams similar to FIGS. 1–4, but illustrating another embodiment and again showing the sequential phase operation; this embodiment employs a reversal of flow in the clearance volume necessitating the use of only two positive displacement means operating in separate interconnected cylinders in response to the thermal cycling of the engine.

DETAILED DESCRIPTION

Figure 3:
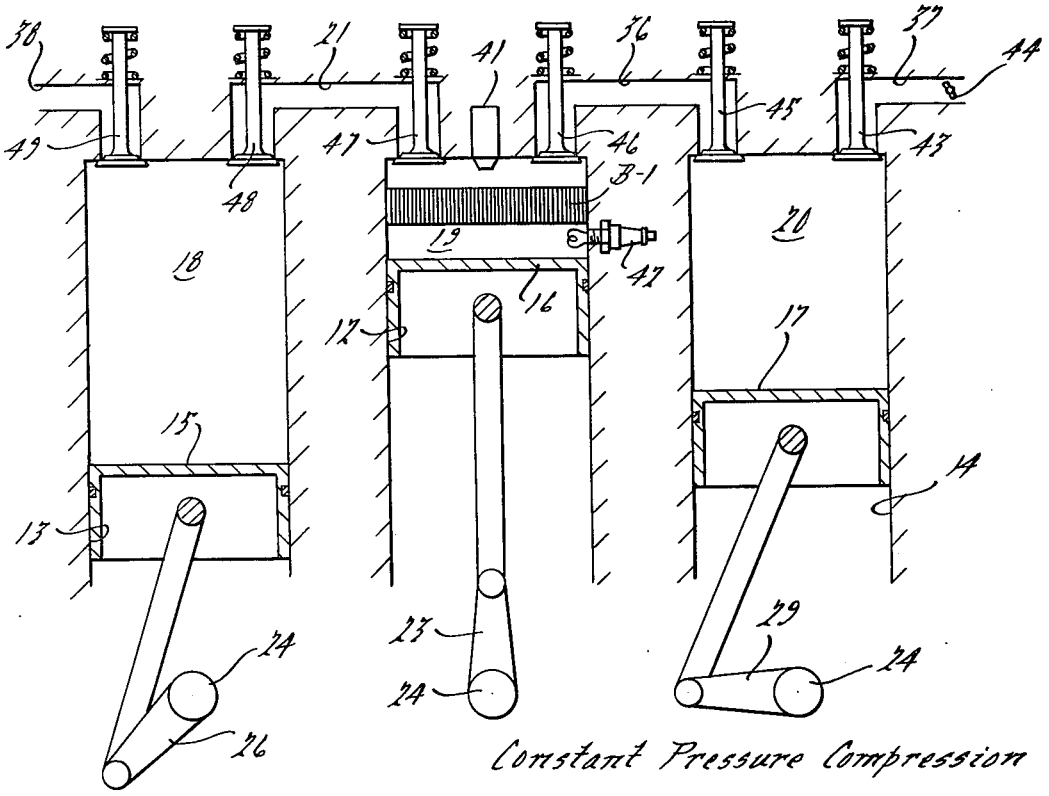

Systems and methods in accordance with the invention provide a novel Ericsson-Stirling cycle engine using a low thermal conductivity working fluid, such as air, in which combustion may be internally supported in an intermittent manner. The internal hot gas volume may be closely controlled and held at a high pressure (about 1200 psi) with the air fuel proportion nonetheless being very high if desired. A unique heat regenerator (serving also as a catalytic combustor) is employed within the hot gas volume of the system and is arranged so that the zone into which fuel is injected is separated from the principal zone of expansion for extracting work from the engine. Thus, high efficiency and a compact, light weight construction is achieved concurrently.

Methods herein, in accordance with the invention, maintain a confined high pressure gas volume in a selected high temperature range (1000°–1700° F) and cycle the gas between separate chambers while extracting work energy in the fashion of the Stirling cycle. A portion of the working fluid, in its initial state, is continuously substituted for the gas mixture that is concurrently withdrawn at pressures compatible with the interior gas volume pressure. A high air-to-fuel ratio can be maintained and the temperature is kept in the range favorable to catalytic combustion, but below that favorable to the formation of oxides of nitrogen and below that which is consistently used in a closed cycle Stirling type engine. In its broad aspects (see FIG. 1), the apparatus of this invention comprises means A defining at least a relatively hot and a relatively cool gas chamber for confining a working fluid having a combustible constituent. Means B is associated with said chambers for shifting a major part of the working fluid between said chambers while extracting work from the thermal energy content thereof; means B is effective to intermittently release thermal energy directly thereinto as a result of combustion of a portion of said working fluid. Means B includes a catalytic combustor B-1 facilitating said combustion and serving as a heat regenerator to the working fluid passing reversibly therethrough. Third means C is coupled to said chambers for substituting new working fluid for existing or combusted working.

Turning to FIGS. 1–4, most of the principal elements of the engine conforming to the present invention are shown. The elements comprise a housing 10 that serves to contain the internal working fluid system of the engine. Walls in the housing and fluid passages outside of the housing combine to define an integral heating and working fluid circuit 11. Said walls provide a principal cylindrical volume 12, auxiliary cylindrical volume 13, and a cylindrical pumping volume 14. Reciprocating elements 15, 16 and 17 are disposed respectively in each of said cylindrical volumes 13, 12 and 14, define respective variable volume spaces 18, 19 and 20. The minimum variable volume space within each of said cylindrical volumes, when combined with the volume of the intercommunicating passage 21 between said volumes, constitutes the unswept clearance volume for the engine. This clearance volume is not interrupted by movement of the positive displacement means or reciprocating elements.

The reciprocating elements comprise either a piston or displacer head. Head 16 is mounted for axial movement within the cylindrical volume 12, the axis of such movement being generally in a vertical direction. The piston or displacer head 16 has an upper working surface **16*a* subject to the pressure of the working fluid or gas in space 19. Mechanical linkage 22 connects the displacer head 16 with a crank 23 extending from a crankshaft 24**; the linkage converts the reciprocating movement of the displacer into rotary motion.

A second piston or expander head 15 is located within volume 13 and is adapted for axial movement in phase with head 16; suitable linkage 25 connects the reciprocating head with a crank 26 which in turn connects to shaft 24. If reciprocating elements 15 and 16 are to be pistons, suitable piston rings should be used about each head; a displacing head permits some leakage of fluid along the sides of the head whereas a piston head should not. The displacer-head-wall clearance is typically very small and permits operation without sealing means while still achieving satisfactory Stirling cycle operation.

Reciprocating head 17 is disposed in volume 14 and acts as a compressor; suitable sealing means 27 are mounted on the head. The head is connected to shaft 24 by linkage 28 and crank 29 so as to operate in timed phase relation with heads 15 and 16.

The integral heating and working fluid containment system 11 thus provides two separate variable volume portions or chambers 18 and 19 for effecting Stirling cycle operation. Although shown as separate portions within separate cylinders, they may be employed as portions of a single cylinder. In any event, they are herein referred to as individual chambers or containment volumes. One volume 18 is that existing between the upper end **13*a* of cylinder 13 and the upwardly facing side 15*a* of the head 15. This is termed a relatively low temperature chamber (compression volume) or slightly higher than ambient. The space existing between the upper end 12*a* of the cylinder 12 and the upper face 16*a* of the head 16 is herein termed a hot volume chamber or space which is maintained at a relatively high temperature. The higher temperatures in space 19 is maintained by injection of energy thereinto, and ambient temperature in space 20** is maintained by drawing in a fresh supply of ambient air which is at a relatively cooler temperature. Thermodynamic cycling in the fashion of a Stirling engine is obtained by having the working fluid (air and fuel) undergo ideally the following sequence: constant pressure expansion (FIG. 1), constant volume cooling (FIG. 2), constant pressure compression (FIG. 3), and constant volume heating (FIG. 4).

Means C comprises peripheral apertures (30-33) in the cylinders to provide ingress and egress of fluid; passage 21 interconnects the spaces 18 and 19 and openings 31 and 32; a passage 36 fluidly connects spaces 19 and 20 and openings 30 and 34; an air intake passage 37 connects space 20 through opening 35 with ambient conditions and exhaust passage 38 connects space 18 through opening 33 with ambient conditions. There is no heat regenerator maintained in such peripheral flow passages and flow through said passages is controlled by suitable poppet valves which are sequenced in their opening and closing position in conformity with the rotary action of the rotary driven means, such as by conventional rocker arm actuation (not shown) operating against valve springs 40.

Means C provides for a fresh combustible mixture and provides extraction of the combusted mixture in controlled relation to the operation of the system and at pressure levels consistent with internal pressures. The compressor cylinder 14 receives the compressor head or piston 17 in reciprocating relation, the compressor head being controlled by the connecting rod 28 coupled to the crank arm 29. Ambient air is supplied to the compressor cylinder through a compressor intake valve 43, the air being derived from an intake conduit having a throttle 44 therein. Compressed air is injected into passage 36 by way of compressor outlet valve 45 and introduced to the top of cylinder 12 via hot chamber inlet valve 46.

Positive exhaust flow is established by the expander head 15 which forces gases out into exhaust passage 38 via exhaust valve 49.

Stirling cycle gas transfer takes place between cylinders 12 and 13; power head 16 operating to force expanded hot gases back out through regenerator B-1 into passage 31 via valve 47 and introduced into the ambient chamber 18 by way of valve 48. Head 15 operates to force the same gas back through passage 31 into the hot chamber.

Means B comprises principally said displacer or piston heads synchronously coupled to driven element for shifting a major part of the working fluid while extracting work energy, fuel injection element 41 and sparking element 42 to intermittently release thermal energy the working fluid as a result of combustion, and catalytic combustor-regenerator by which facilitates combustion and heat storage. The sparking element 42 may be a spark plug or other conventional ignition device powered by voltage supply and controlled by a switch mounted adjacent the voltage supply. The fuel injection element 41 may use a combustible fuel comprised of lead free gasoline, supplied to the high temperature chamber 19 through a fuel injector via a carburetor (having a fuel controller) receiving fuel from a supply (not shown) and air from a compressor. The fuel is not critical because superior burning conditions are provided; diesel fuel and propane, for example, can also be successfully utilized.

The use of a regenerator is vital to the attainment of thermodynamic cycling of a Stirling type engine. The regenerator in this invention is located uniquely within the hot chamber 19 in such a manner that (a) the fuel injector element 42 is separated from the working face **16*a* of the head 16 by such regenerator, (b) the regenerator spans across the lateral dimension of the cylinder 12 so that fluid flow reversibly passing through or into the cylinder must pass entirely through the regenerator, (c) the regenerator is immersed in the extreme end of the clearance volume leading to the hot chamber 19**. The regenerator, so located, can function to more efficiently store heat from combusted gases passing out of the hot chamber and release such heat to the incoming combustible mixture for preheating; in addition, the location permits the regenerator to function as a catalytic combustor which supports combustion without the necessity for continued spark.

A regenerator-catalyst meeting the above needs may be constructed as a honeycomb ceramic matrix having an overall disc configuration. The ceramic matrix may also be coated with a solid oxidation catalyst although the ceramic substrate may inherently operate as an oxidation catalyst depending on selection. The catalytically active component of the catalyst is generally metal either in the elemental state or in the combined state such as an oxide in the ceramic matrix. These metals usually include the heavy metals of the refractory type such as zirconium, vanadium, chromium, manganese, copper, platinum, palladium, iridium, rhodium, ruthenium, cerium, cobalt, nickel and iron.

A useful method of making the regenerator may be to form a plastic solid slurry of a ceramic consisting of lithium aluminum silicate and impregnate paper with this slurry. The impregnated paper is then formed to alternating flat and corrugated layers to define the matrix. Alternatively, magnesium aluminum silicate may be formed as slurry and pressed into extruded sheets having ribs. Extrusion is carried out by using a ribbed die to form sheets of the material with closely spaced projecting ribs or fins. The sheets are cut to size and interleaved with the edges of the ribs fused to the back of the next adjacent sheet. In this manner a foraminous matrix is formed having suitable gas channels with suitable mass to act as a heat storage element. The matrix may then be dipped to obtain a uniform coating of platinumsilver or other suitable combustion catalyst.

Still another mode may be to corrugate strips of a refractory metal (operative as heat sink-regenerator and operative as catalyst) and sandwich the corrugated strips between vaporizable separation sheets; roll the sandwich into a spiral and vaporize the separations. The resulting structure will be somewhat brittle, but this is unimportant to a non-stressed application as herein envisioned.

In operation, the air/fuel mixture in proper ratio (can be in the lean range of 100:1–250:1, if desired) is fed continuously in while the ignition switch is closed to fire the spark element 42. When the high temperature chamber is up to a desired operating temperature, only fuel is thereafter injected by operation of the fuel control, the air supply being separately controlled from the same source to maintain desired proportion.

A pressure-temperature relationship that is supportive of combustion as well as consistant with efficient Stirling cycle operation is maintained in the hot chamber portion of the system. The internal gas is cycled between the high temperature chamber and the ambient temperature chamber in known Stirling cycle fashion, but comprises a semi-closed system, inasmuch as a portion of the working fluid, which comprises not only air but the products of combustion, is constantly replinished with fresh air. The internal working fluid is maintained at an elevated pressure as well as temperature by the action of the compressor head 17 which supplies increments of fresh air in cyclic fashion while the expander head 16 is concurrently operating to remove increments of working fluid from the internal volume. In a very general sense, the crankshaft derives energy from the head 16 as well as some from the action of the head 15. Heads 16, 17 and 15 reciprocate approximately 90–135° out of phase with each other to displace the working fluid therebetween. Energy to drive the heads is extracted from the heat supplied by the combustion in the high temperature chamber 19.

In FIG. 1, the heads are shown in an approximate position representing completion of the expansion phase ideally at constant pressure. During this phase all valves are closed except that fresh air is inducted via open valve 43. Working fluid in chamber 10 has previously had fuel added thereto and the mixture burned during this phase to promote expansion of the volume in space 19, and thereby moving head 16 to extract work. Burning was initiated and sustained by the catalytic regenerator B-1 during the downstroke of head 16. The catalyst ingredient operates at a temperature approximating the theoretical adiabatic flame temperature of the fuel/air admixture charged to the combustion zone. Note that crank 29 is 90° out of phase with crank 23, and crank 24 is about 135° out of phase with crank 23.

In FIG. 2, the heads are shown at the completion of constant volume transfer of working fluid from the hot chamber 19 through catalyst regenerator B-1 (absorbing heat from the flow) to the ambient chamber 18. Valves 47 and 48 must be open to permit flow through passage 21. Additional fresh air induction may be permitted through valve 43. Flow in this phase is ideally at constant volume. The catalyst regenerator B-1 acts also on the upstroke of the head 16, much in the fashion of a catalytic converter, to chemically convert unburned ingredients of the combusted gases passing therethrough. Thus, the catalyst-regenerator may serve both as a combustor and a converter.

Figure 4:
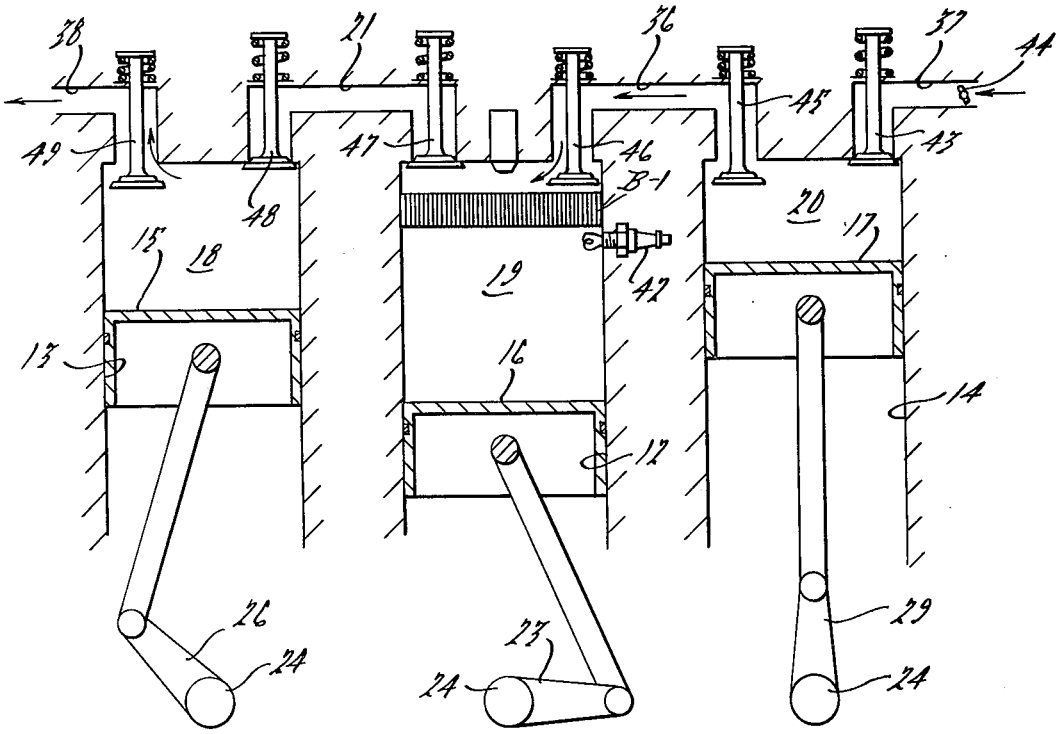

In FIG. 3, the heads are shown at the completion of the compression phase ideally at constant pressure in the hot chamber 19; all valves are closed. Fresh air is being compressed in space 20 by head 17.

In FIG. 4, the heads are shown at the completion of gas transfer from the compression chamber 20 to the hot chamber 19 while being preheated by absorption of heat units from regenerator B-1; this phase takes place ideally at constant pressure. Valves 45 and 46 are open to permit transfer of gas through passage 36; valves 47 and 48 are closed permitting no transfer through passage 21.

The embodiment of FIGS. 1–4 stops loss in engine efficiency by eliminating any leak path for working fluid around the regenerator, permits the engine to burn the combustible mixture at a lower peak temperature by use of a catalytic-regenerator thereby improving emissions, and, most importantly, permits use of conventional engine, such as cast iron and aluminum, to reap cost savings over current closed cycle Stirling engines. Regeneration is improved by reducing the volume of the clearance volume and of the cycled volume for a given power output. The ambient temperature space is effectively purged of exhaust gases by use of uni-directional flow which receives a fresh supply of compressed air in phase with the Stirling cycle.

It is important to note that the injection of fuel may not be in timed relation to the cycling of the engine, inasmuch as the basic consideration is that thermal energy be added to maintain the working temperature. Preferably, however, combustion takes place in this expansion space; such combustion increases the pressure level during expansion thereby increasing the work performed. Concurrently, the tendency of the gas to cool slightly during compression tends to decrease the pressure; this effect also contributes to the network output.

Maximum pressures in the working volume may range from 100–300 atmospheres. Temperature in the high temperature chamber will be in the 1000–1700° F range. Preferably, the gas pressure is maintained at about 1200 p.s.i., taking the pressure at the low pressure point in the cycle at full throttle. In a general case, including engines for vehicular use, the low pressure cycle point at full throttle may be from 100–3000 p.s.i. The compression ratio, typical in the range of 2:1 to 2.5:1 then determines the level at the high pressure point in the cycle. The maximum pressure of approximately 3000 p.s.i. is generally observed in a vehicular Stirling cycle engine.

An alternative embodiment is illustrated in FIGS. 5–8. Housing means 50 defines only two cylindrical volumes 51 and 52. A reciprocal head 53 cooperates within volume 52 to define a variable volume ambient space or chamber 54. Reciprocal head 64 cooperates with cylinder 51 to define a variable volume hot space or chamber 55. The regenerator-catalyst 56 is again immersed totally within the terminal portion of the unswept clear volume most adjacent the hot space 55, the unswept volume consisting of the unswept portion of cylinders 51 and 52 and interconnecting passage 57.

The Stirling cycle flow is reversed through passage 57. FIG. 5 shows the heads at the completion of the expansion phase ideally at constant pressure (combustion having taken place catalyzed by 56). Valves 58, 59 are closed. Valve 60 is closed preventing leakage through exhaust passage 63. Fresh air from blower 61 is prevented by the position of head 53 which closes off intake ports 62.

In FIG. 6, the heads 64 and 53 are shown at the completion of gas transfer (ideally at constant volume) to the slightly higher than ambient chamber 54 from hot chamber 55; valves 58 and 59 are open to permit flow in the direction of the arrow through passage 57. The transferred gas gives up heat units to the catalyst-regenerator 56 while also acting as a converter of emissions at a lower threshold temperature level than required for main combustion. Linkages 65 and 70 connected respectively to crank arms 66 and 69, are in turn connected to shaft 68 at a predetermined angular difference to maintain proper phasing of heads 64 and 53. Ports 62 are now opened. In FIG. 7, two operations take place, (a) compression of the gas in hot space 55 (ideally at constant pressure) and (b) purge of exhaust gases by fresh air from blower 61 through ports 62 and out through passage 63, valve 60 being open in FIG. 8, gas transfer from ambient chamber 54 to hot chamber 55 has taken place, ideally at constant volume. Valve 60 and ports 62 are closed; valves 58 and 59 are open to permit transfer through passage 57, the gas absorbing heat from catalyst-regenerator 56.

In the embodiment of FIGS. 5–8, the regenerator is coated with catalytic material to facilitate combustion and here may be pentoxide. The conditions for effective catalytic combustion must be met in the working volume of this embodiment in accordance with the invention; there must be a high ratio of air/fuel, the pressure must be high, the temperature must be high, and there must be a large degree of contact between the fuel/air mixture and the catalytic surfaces. The use of reversed flow and purging ports provides for a predetermined degree of integral exhaust gas recirculation to the combustible mixture gas entering the hot chamber.

I claim:

1. A hot gas Ericsson-Stirling cycle engine, comprising:

(a) first means defining a relatively hot and a relatively cool gas chamber for confining a working fluid, said working fluid containing a combustible constituent, (b) Second means associated with said chambers for shifting a major part of the working fluid between said chambers while extracting work from the thermal energy content thereof, said second means providing for two constant volume processes in the Ericsson-Stirling cycle and being effective to intermittently release thermal energy directly thereinto as a result of combustion of a portion of said working fluid, said second means having a catalytic combustor and regenerator located in said hot chamber facilitating said combustion of a portion of said working fluid, said catalytic working fluid passing reversibly therethrough, and (c) third means coupled to said chambers for substituting new working fluid for existing or combusted working fluid.

2. A thermodynamic cycling apparatus for an Ericsson-Stirling cycle engine, comprising;

(a) combustion chamber means for combusting an air mixture, (b) first reciprocating means communicating with the interior of said combustion chamber means, (c) ambient chamber means adjacent said combustion chamber means and in communication therewith, (d) second reciprocating means communicating with the interior of said ambient chamber means, (e) rotatable drive means coupled to said first and second reciprocating means to maintain a selected phase relation therebetween and provide for two substantially constant volume processes in said Ericsson-Stirling cycle accompanied by temperature and pressure changes, and (f) regenerator means including a combustion-supporting catalyst disposed within said combustion chamber means separating said latter means from said first reciprocating means, said regenerator means dividing said combustion chamber means so that all combustible and combusted fluids must pass through said regenerator means to engage either of said first or second reciprocating means.

3. The apparatus as in claim 2, in which combustion chamber means has a fuel injector exposed at one side of said regenerator means remote from said first reciprocating means, the volume of said communication between said ambient chamber means and said combustion chamber means, when added to the minimum variable volume of said combustion chamber and minimum ambient chamber together constitute a clearance volume of said apparatus, said regenerator means being located substantially at the terminal end of said clearance volume most adjacent said first reciprocating means.

4. The apparatus as in claim 2, in which means are provided for exhausting and induction of air directly into said ambient chamber means, said exhausting and induction of air being controlled by a compressor piston driven by said rotatable drive means, whereby said exhaust and air are positively driven by a pump in sequential order, said exhaust being purged from said pump space by intake air.

5. The apparatus as in claim 2, in which said regenerator means is comprised of a foraminous refractory matrix effective to act as a flame holder for said combustion.

6. An Ericsson-Stirling cycle engine having an open regenerative thermodynamic cycle with cyclic compression and expansion of the working fluid within working spaces at different temperature levels and with a fresh influx of working fluid added to the working spaces as controlled by valves, said engine having two substantially constant volume processes in said Ericsson-Stirling cycle accompanied by temperature and pressure changes, and comprising:

(a) means defining a variable hot gas volume and a variable low temperature gas volume, and at least one passage interconnecting said volumes, the minimum combined volume of said hot gas volume, the low temperature volume and said at least one passage constituting the clearance volume of said working fluid, and (b) means immersed in and at a terminal portion of said clearance volume effective to act as a regenerator and act as a catalyst to support combustion of said working fluid.

* * * * *